US005732644A

United States Patent [19]

Sell

[11] Patent Number: 5,732,644

[45] Date of Patent: Mar. 31, 1998

[54] DEVICE FOR THE EXHAUST AND VENTILATION SYSTEM ON SHIPS

[75] Inventor: Günther Sell, Norden, Germany

[73] Assignee: Thyssen Nordseewerke GmbH, Emden, Germany

[21] Appl. No.: 699,134

[22] Filed: Aug. 16, 1996

[30] Foreign Application Priority Data

Aug. 18, 1995 [DE] Germany ..... 195 30 362.8

[51] Int. Cl.[6] ..... B63J 2/00

[52] U.S. Cl. ..... 114/211; 62/240; 454/2

[58] Field of Search ..... 114/211, 187; 454/2, 142; 62/239, 240

[56] References Cited

U.S. PATENT DOCUMENTS 2,601,663 6/1952 Lamb ..... 114/211

FOREIGN PATENT DOCUMENTS 171315 9/1985 Japan ..... 454/2

*Primary Examiner*—Jesus D. Sotelo

*Attorney, Agent, or Firm*—Nils H. Ljungman and Associates

[57] ABSTRACT

The device is used in exhaust and ventilation systems on a ship which has a plurality of exhaust and ventilation ducts. The exhaust and ventilation ducts connect the ship's operating systems with the environment. There are retaining elements for the three-dimensional fastening of the exhaust and ventilation ducts. The exhaust and ventilation ducts are mounted in a support frame. The support frame is self-supporting and can be inserted in a vertical shaft on the ship. The support frame has a height which essentially equals the vertical length of the exhaust and ventilation ducts, and extends, starting from the shipboard propulsion system, through a plurality of ship's decks, to a stack end piece.

20 Claims, 6 Drawing Sheets

DEVICE FOR THE EXHAUST AND VENTILATION SYSTEM ON SHIPS

BACKGROUND OF THE INVENTION

1. Field of the Invention:

The present invention relates to a device for the exhaust and ventilation systems on a ship which has a plurality of exhaust and ventilation ducts to connect the shipboard operating systems to the environment and is provided with retaining elements for the three-dimensional fastening of the exhaust and ventilation ducts.

2. Background Information:

Exhaust and ventilation ducts on ships are generally routed so that when a ship is being built, a corresponding locator shaft is created. Then the required ducts are installed individually inside this locator shaft, where they are connected to one another and are fastened in place. This method has a number of disadvantages. The installation and connection of the individual segments of the ducts to one another is relatively time-consuming, to the point where it accounts for a significant portion of the overall the required to build the ship. Moreover, the space available for the installation inside the shaft is relatively narrow, which means that there are restrictions on the number of installation personnel and the equipment that can be used. Special ventilation must also be provided during the welding operations.

Prior known procedures used to install the exhaust and ventilation ducts therefore require a great deal of manpower, and are therefore correspondingly expensive.

OBJECT OF THE INVENTION

The object of the present invention is therefore to create a device of the type described above so that the time required to install it on board a ship is reduced.

SUMMARY OF THE INVENTION

The present invention teaches that this objective can be achieved in that the exhaust and ventilation ducts are mounted in a support frame which is self-supporting and can be installed in a vertical shaft of the ship. The support frame has a height which is essentially equal to the vertical length of the exhaust and ventilation ducts and extends through a plurality of ship's decks to a stack end piece.

As a result of the location of the exhaust and ventilation ducts inside the support frame, a great deal of the preliminary assembly work can be done on land. The support frame is easily accessible from all sides, which makes it easier to assemble, and a number of auxiliary installation devices can be used. The assembled support frame with the exhaust and ventilation ducts can then be inserted vertically from above into a prepared vertical shaft of the ship, where it is fixed in place.

To prevent or minimize vibration, it is preferable either to fix the support frame rigidly in place and to mount the ventilation elements elastically, or to make the support frame flexible, in which case the ventilation elements can be mounted in a rigid fashion.

After the assembly and installation of the support frame, all that is necessary is to make the necessary connections in the vicinity of the ends of the exhaust and ventilation ducts, and to perform any additional installation work which may be necessary in the vicinity of the point where the exhaust and ventilation tubes discharge into the environment, e.g. in the vicinity of any lateral branches and openings.

To transport the exhaust gas and to provide ventilation for the ship's main propulsion system and to assure satisfactory acoustical damping, the present invention teaches that a main exhaust gas tube with a main silencer can be located in the vicinity of the support frame.

The present invention also teaches that at least one exhaust gas line with a silencer can be located in the vicinity of the support frame.

To make possible the economical manufacture of the support frame, the present invention teaches that the support frame can have profile-like braces.

A modular installation can be possible if the support frame has an essentially rectangular cross section.

A stable structure is also promoted if cross braces are preferably located between the corner braces.

The stability of the support frame can be further improved if there preferably is a vertical reinforcement in the vicinity of at least one of the sides of the support frame.

To increase the ease of assembly and installation, the present invention teaches that at least one of the cross braces can be detachable.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Embodiments of the invention are illustrated by way of example in the accompanying drawings, wherein.

DESCRIPTION OF THE PREFERRED EMBODIMENT

Figure 1:
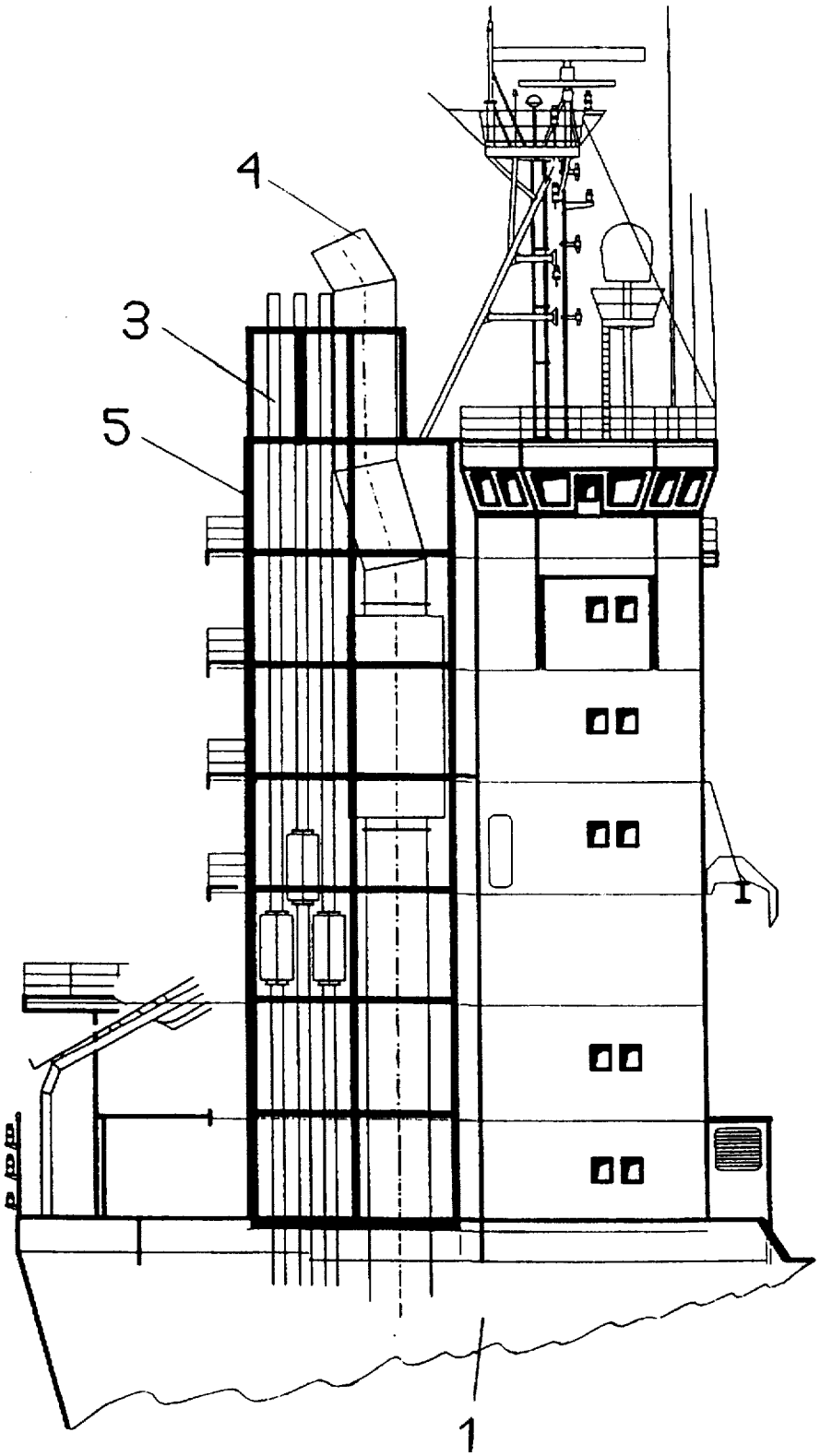
FIG. 1 shows a partial vertical section through a ship with a schematic illustration of the installation of the exhaust and ventilation system.

FIG. 1 is a partial vertical section of a ship 1 which is equipped with a propulsion system and a number of power supply and utility systems. To hold its exhaust and ventilation ducts, the ship 1 has a vertical shaft 3 which extends through a plurality of the decks Of the ship to the vicinity of a stack end piece 4. The vertical shaft 3 has a shaft lining 5 which is preferably made of sheet metal.

Figure 2:
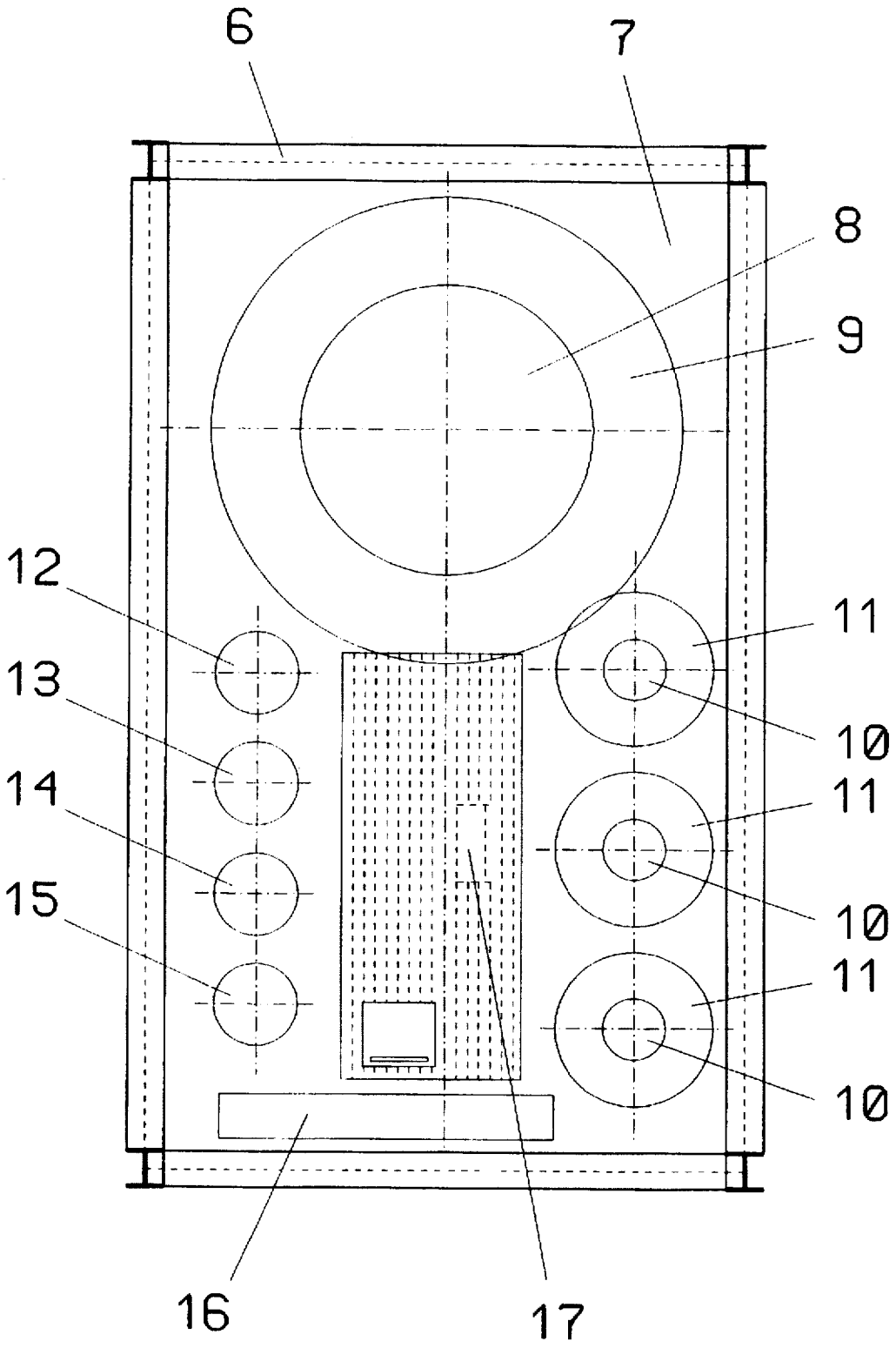
FIG. 2 shows an enlarged horizontal section through the exhaust and ventilation system.

FIG. 2 is a cross section which illustrates the location of a plurality of exhaust and ventilation ducts inside a support frame 6. The support frame 6 occupies the essentially rectangular installation space 7 and itself can have an approximately rectangular cross section. Inside the installation space 7 there can be a main exhaust gas duct 8 with main silencers 9 as well as additional exhaust lines 10 with silencers 11. There also can be a boiler duct 12, a smoke duct 13, a trash incineration system, a separator exhaust duct 14 and a kitchen exhaust duct 15. There can also be a tubular track 16 and gratings 17. The tubular track 16 can contain a bundle of tank ventilation ducts.

The support frame 6 is preferably made of straight profiles which are joined together in the vicinity of their end pieces. The profiles used can be L-shaped profiles, for example. The result is an exhaust and ventilation module which is easy to handle and to position.

Figure 3:
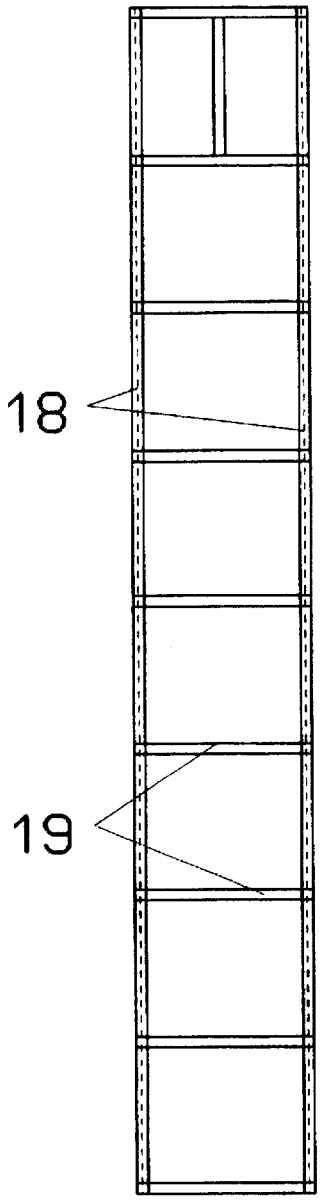
FIG. 3 shows a side view of the support frame for the exhaust and ventilation system.

FIG. 3 is a side view which shows the braced construction of the support frame 6. In addition to corner braces 18, the support frame 6 has cross braces 19 for stability.

To facilitate installation and assembly, some of the cross braces 19 can be removable. For example, it is possible to make every other cross brace 19 removable.

Figure 4:
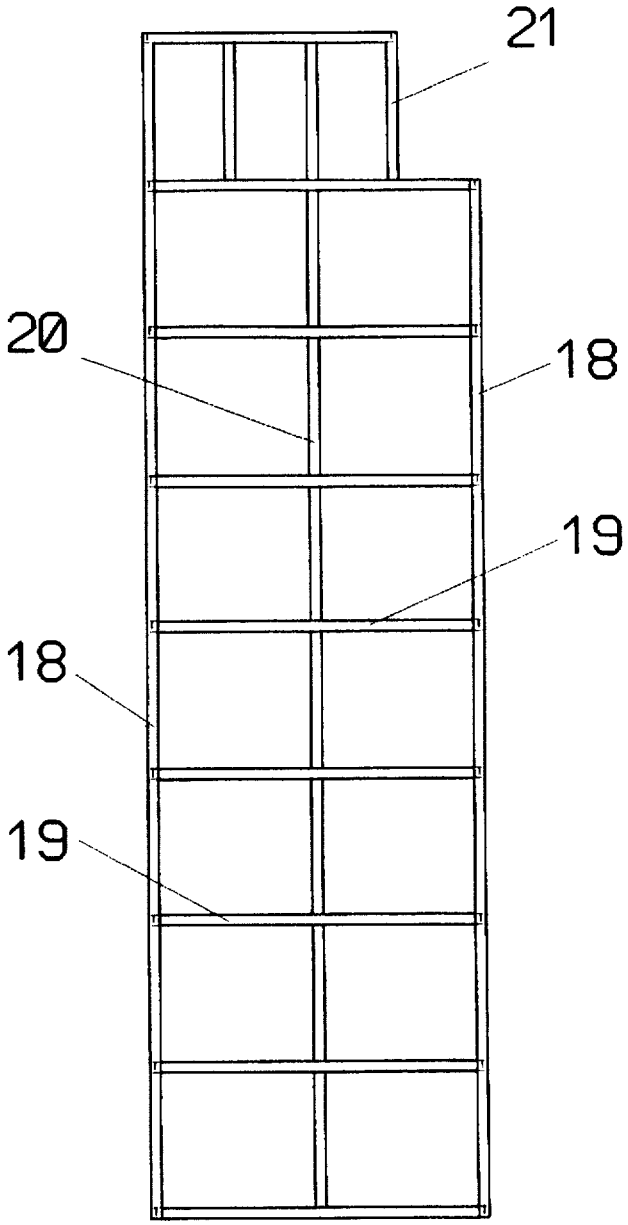
FIG. 4 is an additional side view of the support frame illustrated in FIG. 3.

The side view in FIG. 4 shows that in the vicinity of the wider side pieces, in addition to the cross braces 19 there can be vertical reinforcements 20 which are located approximately in the middle between two corner braces 18. The figure also shows that the support frame 6, when it is mounted in the vertical direction, can be provided in the vicinity of its upper length with a taper 21 which makes a transition in stages into the remaining area of the support frame 6.

Figure 5:
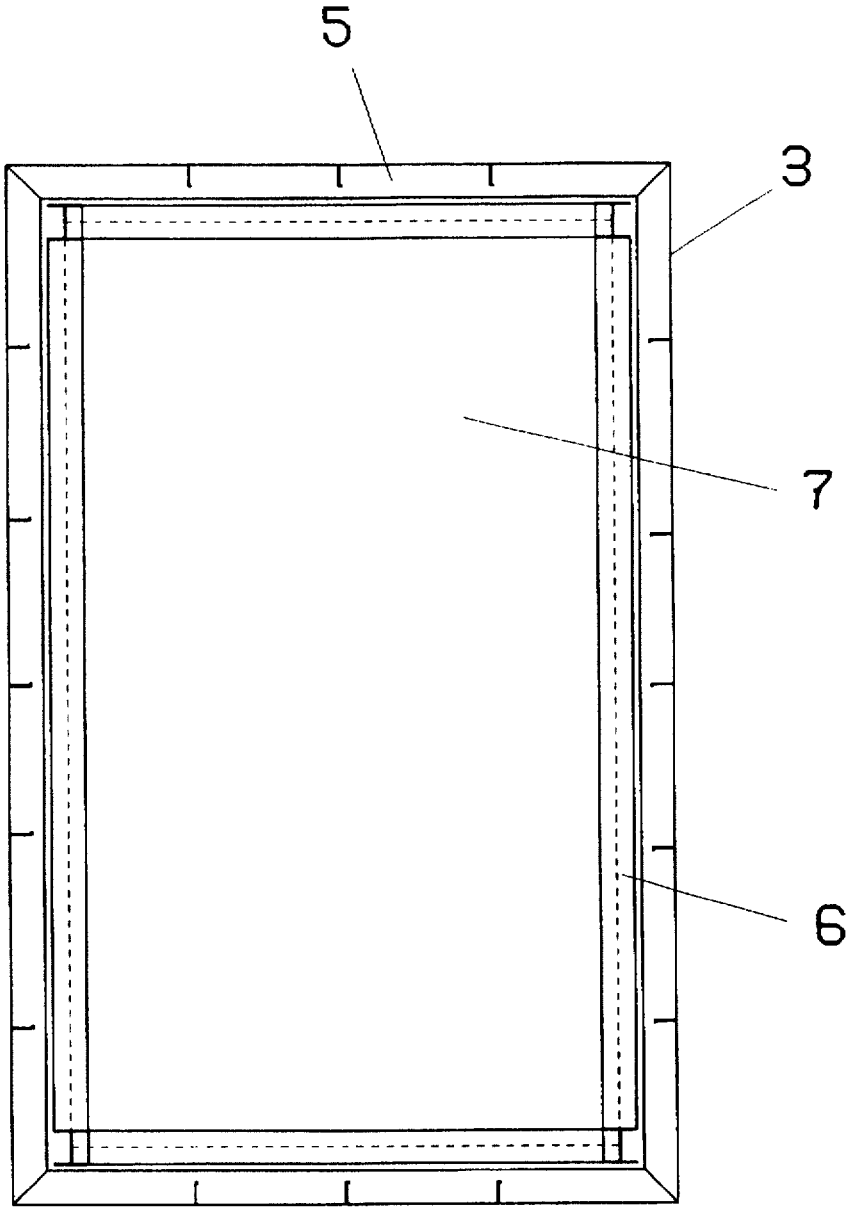
FIG. 5 is a schematic vertical section illustrating the installation of the support frame in the vicinity of a vertical shaft of the ship.

FIG. 5 is a schematic diagram which illustrates a preferable installation of the support frame 6 in the vicinity of the vertical shaft 3 which is provided with the shaft lining 5. For the sake of simplicity, the components installed in the installation space 7 and illustrated in FIG. 2 are not shown in this figure.

The support frame 6 and the associated components can first be assembled on land and then placed in the vertical shaft 3. Pre-assembly of these components can simplify and expedite the construction process. Pre-assembly can also prevent some of the problems associated with the limited space available inside the shaft 3 when installing the ventilation and exhaust ducts. Assembling the structure prior to installation on the ship can thus be economically advantageous.

Figure 6:
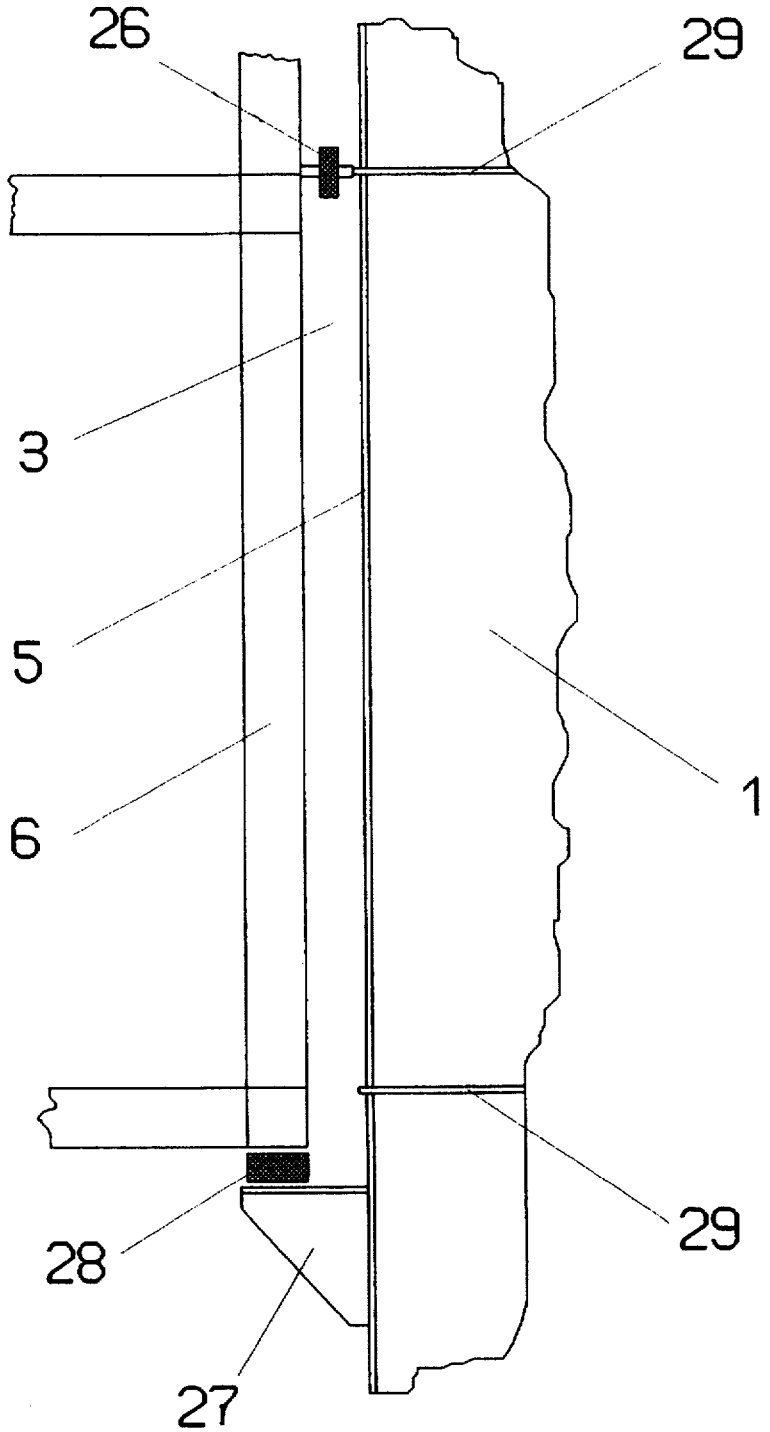
FIG. 6 shows an elastic mounting of the support frame.

FIG. 6 is a schematic illustration which shows preferably an elastic mounting of the support frame 6 in the vicinity of the vertical shaft 3. Between the support frame 6 and the shaft lining 5 there are elastic lateral guides 26. In the vertical direction, mounting projections 27 are located in the vicinity of the shaft lining 5, which mounting projections 27 support elastic bearings 28 on which the support frame 6 lies. The interior hull of the ship 1 is divided in the vertical direction by decks 29. The elastic lateral mountings 26 and the elastic bearings 28 can provide an elastic mounting of the support frame 6 in three dimensions.

Figure 7:
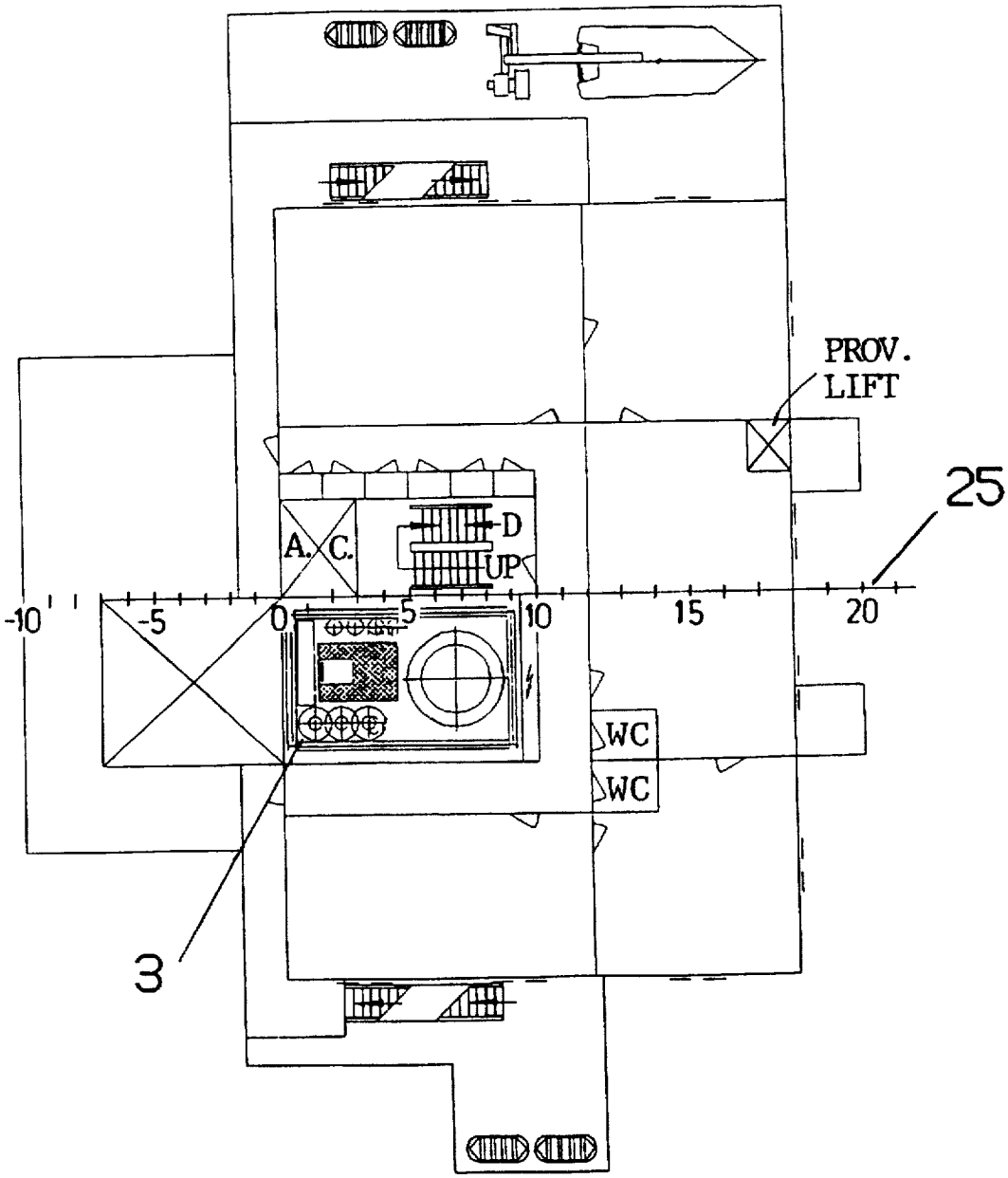
FIG. 7 is an additional partial illustration of a horizontal section through the hull of the ship.

FIG. 7 is a horizontal cross section which illustrates the installation of the vertical shaft 3. FIG. 7 shows that in this embodiment, the vertical shaft 3 is preferably offset with respect to a center line 25 of the hull of the ship 1, and that one of the wider sides of the vertical shaft 3 is located in the vicinity of the center line 25 of the hull of the ship 1.

One feature of the invention resides broadly in the device for the exhaust and ventilation system on ships which has a plurality of exhaust and ventilation ducts which connect the ship's operating systems with the environment and which is provided with retaining elements for the three-dimensional fastening of the exhaust and ventilation ducts, characterized by the fact that the exhaust and ventilation ducts are mounted in a support frame 6 which is self-supporting and can be inserted in a vertical shaft 3 of the ship 1, and that the support frame 6 has a height which essentially equals the vertical length of the exhaust and ventilation ducts through a plurality of ship's decks to a stack end piece 4.

Another feature of the invention resides broadly in the device characterized by the fact that a main exhaust duct 8 with a main silencer 9 is located in the vicinity of the support frame 6.

Yet another feature of the invention resides broadly in the device characterized by the fact that there is at least one exhaust line 10 with a silencer 11 in the vicinity of the support frame 6.

Still another feature of the invention resides broadly in the device characterized by the fact that the support frame 6 is held in the horizontal direction by at least one elastic lateral guide 26.

A further feature of the invention resides broadly in the device characterized by the fact that the support frame 6 is held in the vertical direction by means of at least one elastic bearing 28.

Another feature of the invention resides broadly in the device characterized by the fact that the support frame 6 is rigidly connected to the ship 1 and that elements installed inside the support frame 6 are mounted elastically relative to the support frame 6.

Yet another feature of the invention resides broadly in the device characterized by the fact that the support frame 6 has profile-like braces 18.

Still another feature of the invention resides broadly in the device characterized by the fact that the support frame 6 is provided with a taper 21 in the vicinity of its upper length in the vertical direction.

A further feature of the invention resides broadly in the device characterized by the fact that the support frame 6 has an essentially rectangular cross section.

Another feature of the invention resides broadly in the device characterized by the fact that cross braces 19 are located between the corner braces 18.

Yet another feature of the invention resides broadly in the device characterized by the fact that a vertical reinforcement 20 is located in the vicinity of at least one of the sides of the support frame 6.

Still another feature of the invention resides broadly in the device characterized by the fact that at least one of the cross braces 19 is detachable.

The following U.S. Pat. Nos., which show examples of modular ships' systems, namely: 4,711,193 issued to Latza and Mock; 4,678,439 issued to Schlichthorst; 4,630,561 issued to Franz, et al.; 4,579,073 issued to Sadler and Schmidt; and 4,561,372 issued to Franz, et al., as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Examples of ships' exhaust and ductwork systems, and components associated therewith, which may be used in conjunction with the embodiments of the present invention, may be found in the following U.S. Pat. Nos. 4,167,857, issued to Nishijima et al.; 4,428,318, issued to Huchzermeier; and 5,232,385, issued to Hatfield.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the Components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 30 362.8-22, filed on Aug. 18, 1995, having inventor Gunther Sell, and DE-OS 195 30 362.8-22 and DE-PS 195 30 362.8-22, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A ship, said ship comprising:

a hull;

a plurality of decks disposed within said hull;

a vertical shaft opening disposed in said hull;

said vertical shaft opening extending through said plurality of decks and having a length defined substantially transverse to said plurality of decks;

a modular exhaust and ventilation system disposed in said vertical shaft opening, said modular system having a length defined transverse to said plurality of decks;

said modular system comprising:

a support frame, said support frame extending through said plurality of decks and having a length substantially transverse to said plurality of decks;

said support frame being self-supporting to maintain the form of said support frame without substantial support from said plurality of decks; and a plurality of exhaust and ventilation ducts disposed within said support frame.

2. The ship according to claim 1 wherein said length of said support frame is substantially equal to said length of said modular system.

3. The ship according to claim 2 wherein said plurality of exhaust and ventilation ducts comprises:

a main exhaust duct; and a main silencer operatively connected to said main exhaust duct.

4. The ship according to claim 3 wherein said plurality of exhaust and ventilation ducts comprises:

at least one additional exhaust duct; and at least one additional silence, each of said at least one additional silencer being operatively connected to said at least one additional exhaust duct.

5. The ship according to claim 4 wherein said modular system comprises at least one elastic lateral guide for stabilizing said modular system in a direction parallel to said plurality of decks.

6. The ship according to claim 5 wherein said modular system comprises at least one elastic bearing to position said support frame in a direction transverse to said plurality of decks.

7. The ship according to claim 6 wherein:

said support frame is rigidly affixed to said ship; and said plurality of exhaust and ventilation ducts is elastically affixed to said support frame.

8. The ship according to claim 7 wherein:

said support frame has a first end and a second end;

said support frame has first and second sides opposing one another;

said support frame has third and fourth sides opposing one another and disposed perpendicular to said first and second sides;

said first end of said support frame is disposed substantially adjacent said hull;

said support frame has a cross-section along the length of said support frame, said cross-section being further defined by said first and second opposing sides and said third and fourth opposing sides;

said cross-section is substantially transverse to said vertical shaft opening;

said cross-section is substantially rectangular;

said cross-section is a first cross section;

said first cross-section is adjacent said first end of said support frame;

said support frame has a second cross-section;

said second cross-section is adjacent said second end of said support frame; and said first cross-section is greater than said second cross-section.

9. The ship according to claim 8 wherein said support frame comprises a plurality of corner braces, each of said plurality of corner braces being disposed to connect one of said first and second sides and one of said third and fourth sides.

10. The ship according to claim 9 wherein said modular system comprises:

a plurality of cross braces;

each of said cross braces being disposed between adjacent ones of said plurality of corner braces;

at least one of said cross braces being detachable from said modular system; and a vertical reinforcement, said vertical reinforcement being disposed adjacent at least one of said first second third and fourth sides of said support frame.

11. A modular exhaust and ventilation system for a ship, the ship comprising a plurality of decks and a ship bottom within a hull, said ship further comprising a vertical shaft for receiving skid modular system, said modular system comprising:

a plurality of exhaust and ventilation ducts;

a support frame for supporting said plurality of exhaust and ventilation ducts, said support frame having a length; and said support frame being self-supporting to maintain the form of said support frame without substantial support from said plurality of decks.

12. The modular system according to claim 11 wherein:

said modular system has a vertical length;

said support frame has a vertical length; and said vertical length of said support frame is substantially equal to said vertical length of said modular system.

13. The modular system according to claim 12 wherein said plurality of exhaust and ventilation ducts comprises:

a primary exhaust duct; and a primary silencer, said primary silencer being disposed to damp sound from said primary exhaust duct.

14. The modular system according to claim 13 wherein said plurality of exhaust and ventilation ducts comprises:

at least one secondary exhaust line; and at least one secondary silencer, said at least one secondary silencer being disposed to damp the sound of said at least one secondary exhaust line.

15. The modular system according to claim 14 comprising at least one elastic lateral guide, said at least one elastic lateral guide being disposed to limit motion of said modular system in a direction transverse to said vertical length of said modular system upon said modular system being installed in the ship.

16. The modular system according to claim 15 comprising at least one elastic bearing, said at least one elastic bearing being disposed to limit motion of said modular system in a direction parallel to said vertical length of said modular system upon said modular system being installed in the ship.

17. The modular system according to claim 16 wherein:

said modular exhaust system comprises means for rigidly connecting said modular exhaust system to the ship; and said plurality of exhaust and ventilation ducts is elastically mounted on said support frame.

18. The modular system according to claim 17 wherein:

said support frame comprises an axis parallel to said vertical length; and said support frame comprises a vertical reinforcement, said vertical reinforcement being disposed parallel to said axis.

19. The modular system according to claim 18 wherein:

said support frame has a first end and a second end;

said support frame has first and second sides opposing one another;

said support frame has third and fourth sides opposing one another and disposed perpendicular to said first and second sides;

said first end of said support frame is disposed substantially adjacent the hull of the ship upon said support frame being disposed in the vertical shaft;

said support frame has a cross-section defined along the length of said frame, said cross-section being further defined by said first and second opposing sides and said third and fourth opposing sides;

said cross-section is substantially transverse to said vertical shaft opening;

said cross-section is substantially rectangular;

said cross-section is a first cross section;

said first-cross section is adjacent said first end of said support frame;

said support frame having a second cross-section;

said second cross-section is adjacent said second end of said support frame; and said first cross-section is greater than said second cross-section.

20. The modular system according to claim 19 wherein said support frame comprises:

a plurality of corner braces, each of said plurality of corner braces being disposed to connect one of said first and second sides with one of said third and fourth sides; and a plurality of cross braces, each of said plurality of cross braces being disposed to connect one of said plurality of corner braces to an adjacent one; and at least one of said plurality of cross braces being removable from said support frame.

* * * * *

UNITED STATES PATENT AND TRADEMARK OFFICE

CERTIFICATE OF CORRECTION

PATENT NO. : 5,732,644

DATED : March 31, 1998

INVENTOR(S) : Günther SELL

It is certified that error appears in the above-identified patent and that said Letters Patent is hereby corrected as shown below:

In column 1, line 19, after 'overall', delete "the" and insert --time--.

In column 7, line 4, Claim 11, after 'receiving', delete "skid" and insert --said--.

Signed and Sealed this

Eighth Day of September, 1998

*Attest:*

*Attesting Officer*

Bruce Lehman

BRUCE LEHMAN

*Commissioner of Patents and Trademarks*